US007614405B2

(12) United States Patent
Allen et al.

(10) Patent No.: US 7,614,405 B2
(45) Date of Patent: Nov. 10, 2009

(54) COSMETIC COMPACT

(75) Inventors: Harry S. Allen, New York, NY (US); Shawn Booth, Sheboygan, WI (US); Thomas Yu, Staten Island, NY (US)

(73) Assignee: Target Brands, Inc., Minneapolis, MN (US)

( * ) Notice: Subject to any disclaimer, the term of this patent is extended or adjusted under 35 U.S.C. 154(b) by 237 days.

(21) Appl. No.: 11/670,854

(22) Filed: Feb. 2, 2007

(65) Prior Publication Data

US 2007/0204876 A1 Sep. 6, 2007

Related U.S. Application Data

(60) Provisional application No. 60/779,405, filed on Mar. 3, 2006.

(51) Int. Cl.
*A45D 33/00* (2006.01)
*A45D 33/22* (2006.01)

(52) U.S. Cl. ..... 132/295; 132/293

(58) Field of Classification Search ..... 132/293–297, 132/300, 305; D28/82, 79; 206/581, 823
See application file for complete search history.

(56) References Cited

U.S. PATENT DOCUMENTS

| | | | | |
|---|---|---|---|---|
| D61,753 | S | 1/1923 | Foster | |
| D63,502 | S | 12/1923 | Slater | |
| 1,546,302 | A | 7/1925 | Mehigan | |
| D117,639 | S | 11/1939 | Rich | |
| D145,100 | S | 6/1946 | Muller-Munk | |
| D176,876 | S | 2/1956 | Sutton | |
| 2,734,517 | A | 2/1956 | Ferraro | |
| 3,392,868 | A * | 7/1968 | Pfrommer | 220/520 |
| D280,137 | S | 8/1985 | Guttenplan et al. | |
| D280,245 | S | 8/1985 | Buchet | |
| D280,354 | S | 8/1985 | Bakic | |
| D286,331 | S | 10/1986 | Scoccola | |
| D299,561 | S | 1/1989 | Bakic | |
| 4,826,014 | A | 5/1989 | Schefer | |
| D302,872 | S | 8/1989 | Bakic | |
| D303,582 | S | 9/1989 | Gavin | |
| D303,724 | S | 9/1989 | Horng et al. | |
| 5,031,764 | A | 7/1991 | Meador et al. | |
| D370,306 | S | 5/1996 | Stevens | |
| 5,626,155 | A | 5/1997 | Saute | |
| 5,632,394 | A * | 5/1997 | Mecca et al. | 220/824 |
| 5,735,297 | A | 4/1998 | Litton | |
| D394,131 | S | 5/1998 | Litton | |
| D445,563 | S | 7/2001 | Cautereels | |
| D462,484 | S | 9/2002 | Lai | |

(Continued)

OTHER PUBLICATIONS

"Another Time Vintage Apparel," www.anothertimevintageapparel.com/stock_FDSE, Printed on Jan. 26, 2006 (compact available in 1970's).

(Continued)

*Primary Examiner*—Robyn Doan
(74) *Attorney, Agent, or Firm*—Griffiths & Seaton PLLC

(57) ABSTRACT

A cosmetic compact includes a base and a lid. The base defines an inside surface and at least one receptacle for storing a cosmetic item extending from the inside surface into the base. The lid is coupled with the base in a manner allowing the lid to rotate relative to the base about a rotational axis. The rotational axis is substantially perpendicular to the inside surface of the base. The lid is configured to rotatably transition from a closed position where the lid covers the at least one receptacle and an open position where the at least one receptacle is accessible by a user. Other cosmetic compacts and associated methods are also disclosed.

22 Claims, 6 Drawing Sheets

U.S. PATENT DOCUMENTS

| | | | | |
|---|---|---|---|---|
| 6,540,083 | B2 * | 4/2003 | Shih | 206/581 |
| D497,037 | S | 10/2004 | Rodriguez | |
| 6,988,630 | B2 * | 1/2006 | Matsumoto | 220/254.4 |
| 2002/0036155 | A1 | 3/2002 | Freeman et al. | |
| 2003/0010351 | A1 | 1/2003 | de Laforcade | |
| 2003/0205236 | A1 * | 11/2003 | Lin | 132/293 |

OTHER PUBLICATIONS

"Cosmetic Times," www.cosmetictimes.com/discount-cosmetics-perfume-detail.asp?id=04647678406&AffiliateID=51012612005, Printed on Jan. 26, 2006.

"HQ Hair," www.hqhair.com/code/products.asp?PageID=249&SectionID=371&FeaturedID=3582&FeaturedProduct=5067& pID=1, Printed Jan. 26, 2006.

* cited by examiner

COSMETIC COMPACT

CROSS-REFERENCE TO RELATED APPLICATIONS

This patent application claims priority under 35 U.S.C. §119(e) to U.S. Provisional Patent Application Ser. No. 60/779,405 entitled "COSMETIC COMPACT," having a filing date of Mar. 3, 2006, the contents of which are incorporated herein by reference. This application is related to U.S. Design Pat. Application Ser. No. 29/255,095 entitled "COMPACT," having a filing date of Mar. 3, 2006, the contents of which are incorporated herein by reference.

BACKGROUND OF THE INVENTION

Cosmetic compacts provide users with easily transported and relatively condensed housings for cosmetics, applicators, mirrors, etc. Conventional compacts typically include a base storing one or more cosmetic items such as make-up items (e.g., powder, foundation, eye shadow, blush, lip gloss, lipstick, etc.) and/or one or more cosmetic applicators for applying or otherwise using the cosmetic item. A lid is rotatably coupled to the base with a hinge in a manner allowing the lid to be selectively transitioned between a closed position, in which the make-up or other cosmetic item(s) maintained by the base is enclosed, and an open position, in which the cosmetic item(s) maintained by the base is accessible for use.

The lid oftentimes includes a mirror on an inside surface thereof to assist a user in applying or otherwise using the cosmetic item(s) maintained in the compact. To facilitate application of the cosmetic item(s), it is typically desired to view the mirror, if any, while the cosmetic item(s) is accessible (i.e., while the lid is in an open position). To facilitate simultaneous accessibility of the cosmetic item(s) and viewing of the mirror, the hinge coupling the lid to the base is typically positioned at an outside edge of the compact, and the lid is configured to be rotated or flipped about a rotational axis that is substantially parallel with the extension of the base. In this manner, when the lid is in the open position, not only is the cosmetic item(s) accessible, but the mirror is able to be viewed as well.

In addition to cosmetic compacts, cosmetic retailers also often offer perfumes to consumers. Perfume can be offered in one of a solid or powder form, or more commonly a liquid form, and is typically sold to consumers in a premixed form including a plurality of different fragrances in particular ratios created by a master perfumer and replicated in large quantities. As such, the consumer chooses from premixed scents and typically does not have the option of designing or mixing their own customized perfume from a plurality of fragrances.

SUMMARY OF THE INVENTION

One aspect of the present invention provides a cosmetic compact including a base and a lid. The base defines an inside surface and at least one receptacle for storing a cosmetic item extending from the inside surface into the base. The lid is coupled with the base in a manner allowing the lid to rotate relative to the base about a rotational axis that is substantially perpendicular to the inside surface of the base. The lid is configured to rotatably transition from a closed position where the lid covers the at least one receptacle and an open position where the at least one receptacle is accessible by a user. Other related products, systems, and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

Compacts storing cosmetic items are of wide popularity due to their condensed nature and configuration suited for frequent transport. A compact according to embodiments of the present invention provides a user storage of one or more cosmetic items, such as make-up items, fragrance items, skin care items, baby care items applicators, etc. within a base and has a lid rotatably coupled thereto. The lid is configured to open and close in a slidably rotational manner as opposed to the flip-like opening of conventional cosmetic compacts. More specifically, the compacts described herein are configured with a lid that rotates in a plane substantially parallel to an extension of the base. In one embodiment, the compact is configured to include two or more solid fragrances adapted to be mixed with one another as desired by a user to create custom perfumes.

Figure 1:
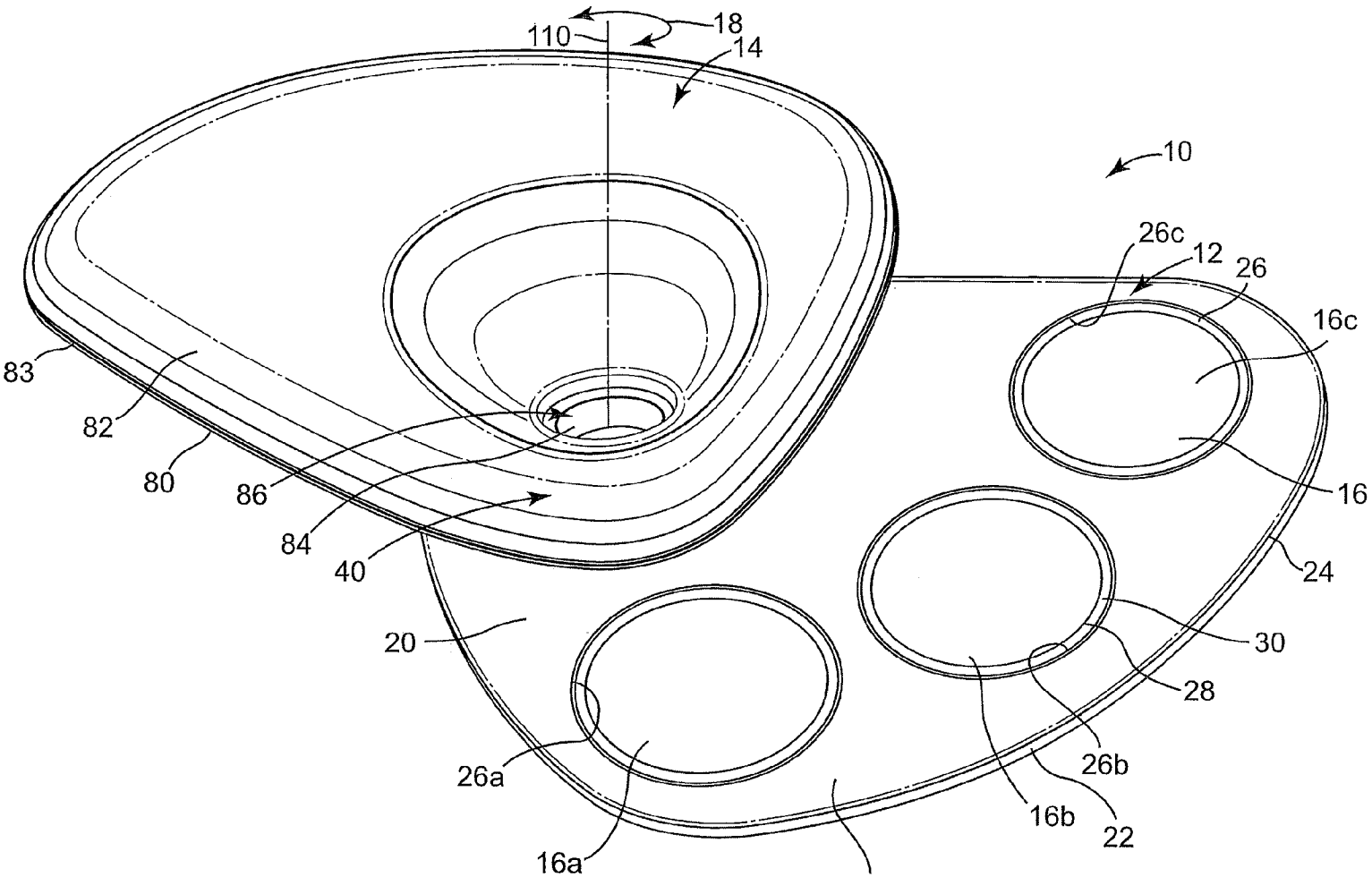
FIG. 1 is a perspective view illustration of one embodiment of a cosmetic compact in an open position, according to the present invention.
Figure 2A:
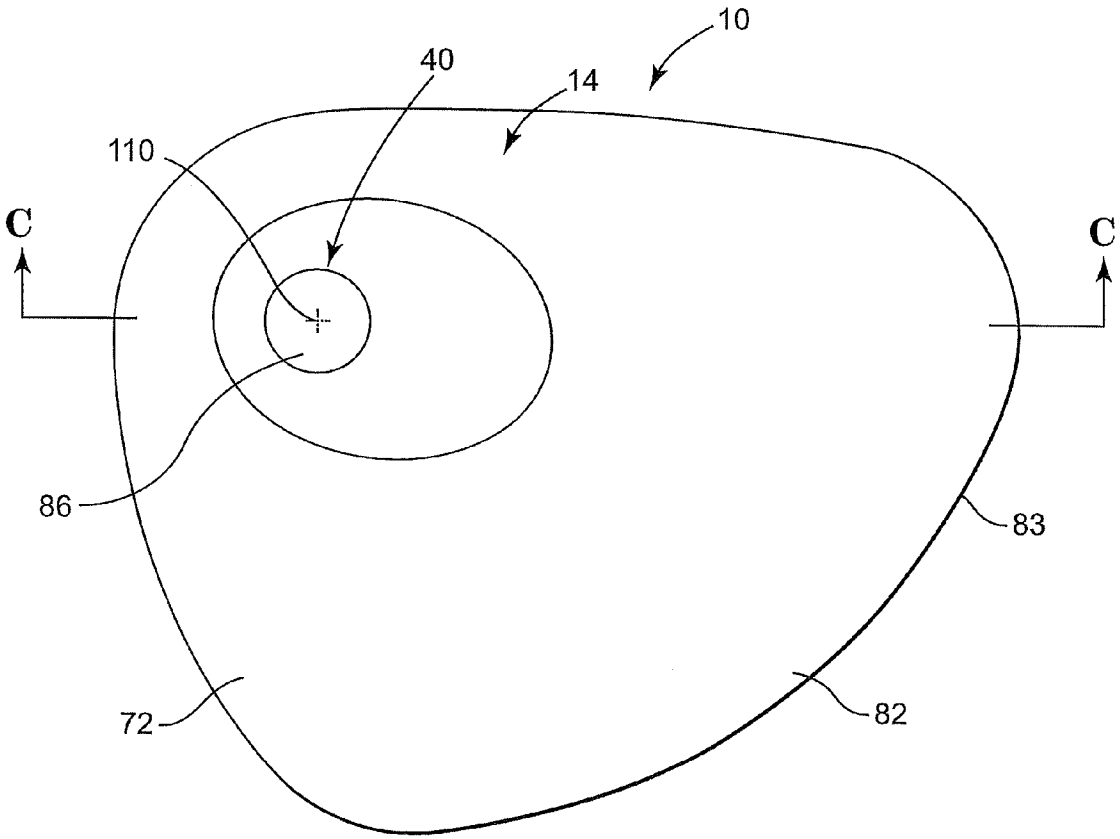
FIG. 2A is a top view illustration of one embodiment of the cosmetic compact of FIG. 1 in an closed position.
Figure 2B:
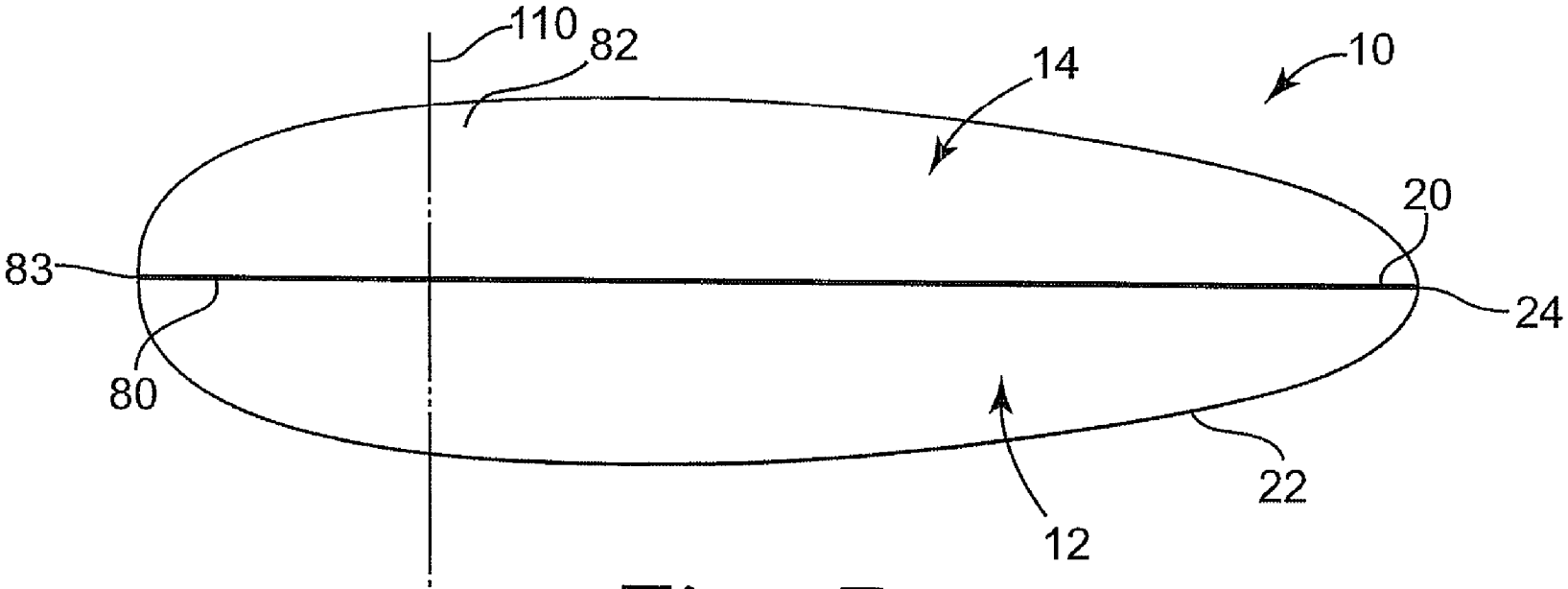
FIG. 2B is a front view illustration of one embodiment of the cosmetic compact of FIG. 2A.
Figure 2C:
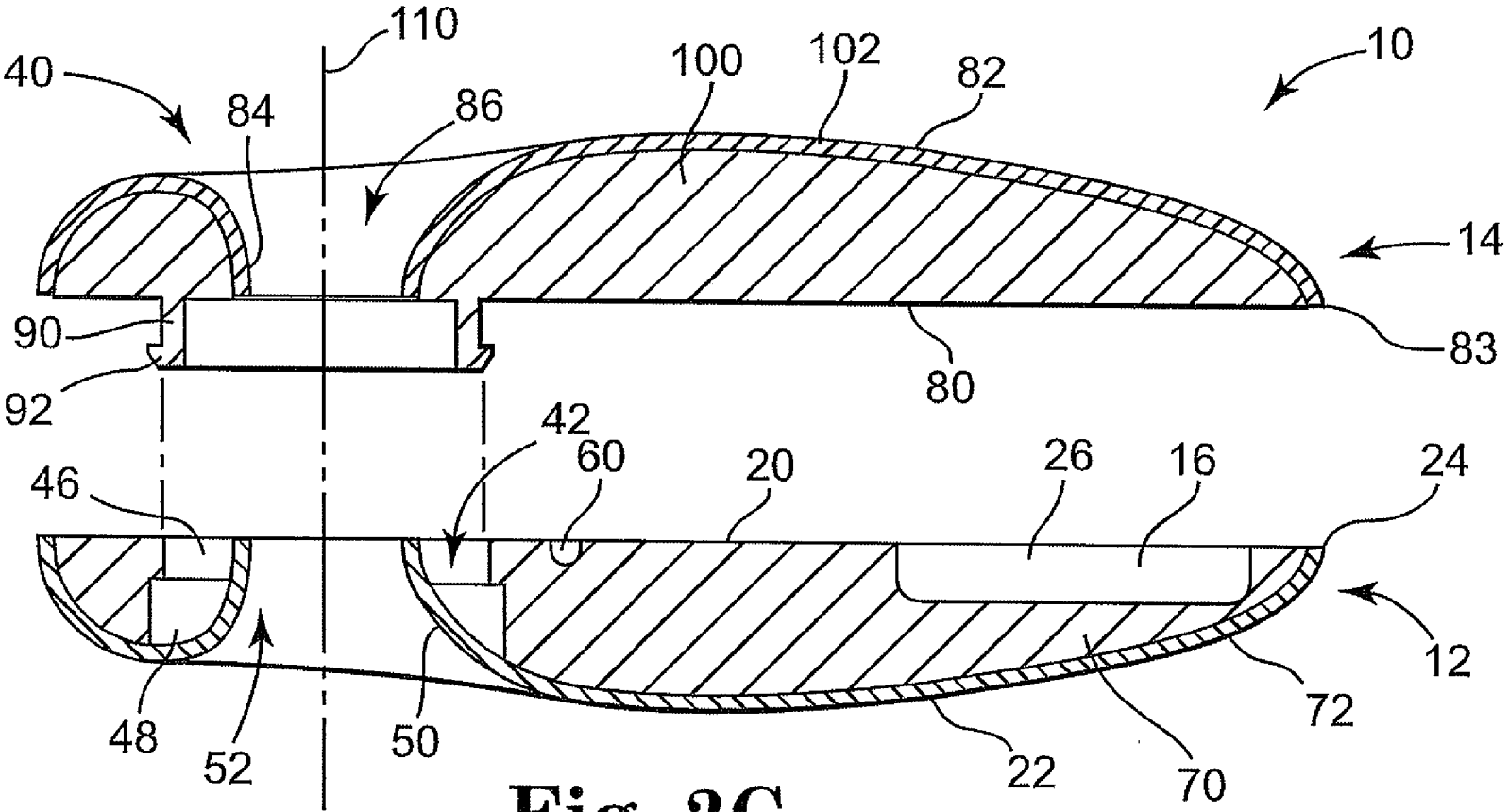
FIG. 2C is an exploded, cross-sectional view illustration of one embodiment of the cosmetic compact of FIG. 2A taken along the line C-C.

Turning to the figures, FIGS. 1-2C illustrate one embodiment of a cosmetic compact or container 10, according to the present invention. The cosmetic compact 10 includes a first member or base 12 and a second member or lid 14. Base 12 is configured to receive one or more cosmetic items 16 such as make-up items, skin care items, baby care items, fragrance items, cosmetic applicators, etc. Lid 14 is rotatably coupled to base 12 such that lid 14 is configured to rotate as generally indicated by arrow 18 between an open position shown in FIG. 1 and a closed position shown in FIGS. 2A-2B. When lid 14 is in the closed position, lid 14 covers cosmetic item(s) 16 and cosmetic compact 10 is configured for storage and/or transport. When lid 14 is in the open position, cosmetic item(s) 16 are accessible and cosmetic compact 10 is configured for use.

Figure 3:
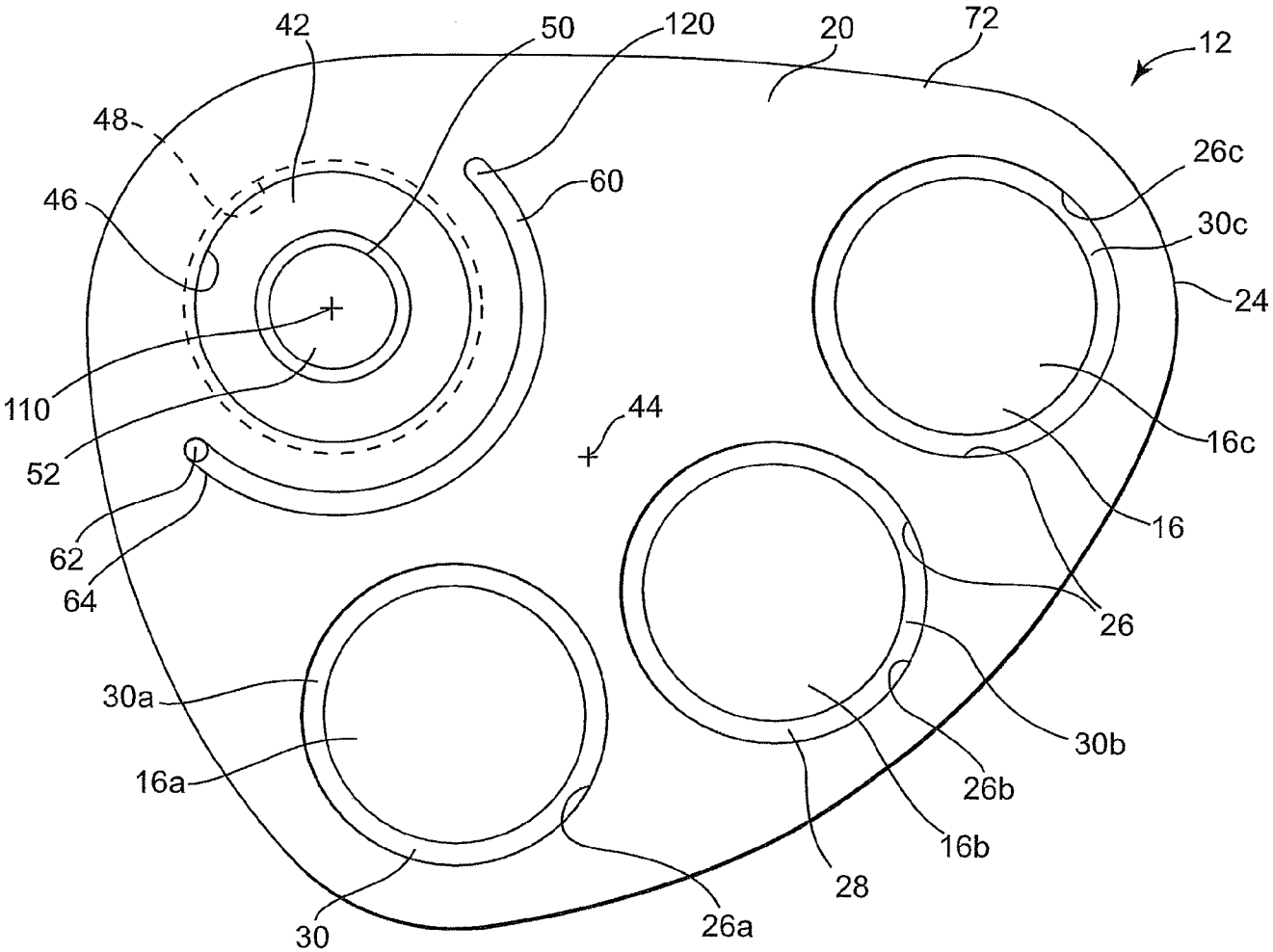
FIG. 3 is a top view illustration of one embodiment of a base of the cosmetic compact of FIG. 1.

Referring to FIGS. 1 and 3, in one embodiment, base 12 defines a generally planar inside surface 20 and an outside surface 22 opposite inside surface 20. In one example, outside surface 22 is substantially convex and is spaced from inside surface 20 except near a perimeter edge 24 of inside surface 20 where the overall thickness of base 12 decreases such that outside surface 22 curves toward and intersects edge 24 of inside surface 20. As such, base 12 is presented with a sleek and smooth-line exterior appearance. Base 12 defines one or more receptacles or cavities 26 for receiving and storing cosmetic item(s) 16. As illustrated with additional reference to the cross-sectional view of FIG. 2C, each receptacle 26 extends from inside surface 20 into an interior of base 12. In one example, base 12 defines a first receptacle 26*a*, a second receptacle 26*b*, and a third receptacle 26*c* each spaced from one another and configured to respectively receive a first cosmetic item 16*a*, a second cosmetic item 16*b*, and a third cosmetic item 16*c*. Although illustrated as being three receptacles 26 and three cosmetic items 16, any suitable number of receptacles 26 and cosmetic items 16 may be incorporated into base 12. In one embodiment, each cosmetic item 16 is formed in a metal pan 28, and metal pan 28 is placed in receptacle 26 and coupled to base 12 by friction fit, with adhesive, or by any other suitable coupling technique. In one embodiment, cosmetic items 16 may be removable from and replaceable with other cosmetic items 16 to increase the versatility of compact 10.

In one embodiment, each cosmetic item 16 is one of a make-up item such as powder, foundation, blush, eye shadow, lip gloss, lip stick, etc., a fragrance item such as a solid fragrance, and a skin care item, a baby care item, and an applicator item. In one embodiment, each cosmetic item 16 is a different note fragrance where each of the fragrances 16 are configured to be mixed with and to complement one another prior to or during application of the fragrance(s) to the user. For example, first fragrance 16*a* is a base or bottom note fragrance, second fragrance 16*b* is a middle note fragrance, and third fragrance 16c is a top note fragrance. Top note fragrances are the lightest and most volatile fragrances and typically provide the first impression of a perfume. Middle note fragrances are slightly heavier and less volatile and, accordingly, more gradually develop and last longer than top note fragrances. Base note fragrances are the heaviest fragrances and have the longest lasting effect. With this in mind, a user is able to apply differing amounts of one or more of the fragrances 16 at each application, and thereby is able to customize the resulting perfume applied to the user.

To facilitate user identification and differentiation of the different fragrances 16, in one embodiment, fragrances 16 themselves are formed to have different colorings. In another embodiment, base 12 includes colored indicia 30 to facilitate identification and differentiation of the fragrances. More specifically, in one example, the colored indicia 30 includes colored rings 30*a*, 30*b*, and 30*c*, each formed around one of the receptacles 26*a*, 26*b*, and 26*c* housing fragrances 16*a*, 16*b*, and 16*c*, respectively, where each colored ring 30*a*, 30*b*, and 30*c* is a different color.

The base 12 additionally includes at least a portion of a coupling mechanism 40 (illustrated e.g. in FIGS. 1 and 2C) to rotatably couple base 12 to lid 14. In one embodiment, base 12 defines a generally cylindrical cavity 42 laterally offset from a center, which is generally illustrated in FIG. 3 at 44, of base 12. More specifically, referring to the cross-sectional view of FIG. 2C and the top view of FIG. 3, cavity 42 is centered on a rotational axis 110 of lid 14 as will be further described below. In one embodiment, cavity 42 includes a first portion 46 and a second portion 48 positioned axially adjacent one another. First portion 46 of cavity 42 extends from inside surface 20 partially towards outside surface 22. A second portion 48 of cavity 42 extends from an end of first portion 46 opposite inside surface 20 toward outside surface 22.

In one embodiment, first portion 46 and second portion 48 are each substantially cylindrical, and second portion 48 has a larger diameter than first portion 46. Accordingly, cavity 42 is formed as a generally cylindrical and stepped cavity. In one example, cavity 42 does not extend through outside surface 22, such that cavity 42 is generally hidden when viewed from outside surface 22 of base 12. In one embodiment, a generally cylindrical internal wall 50 is concentrically centered and extends from outside surface 22 longitudinally through cavity 42 forming a generally cylindrical or frustoconical aperture 52 therethrough.

Base 12 additionally defines a curvilinear track or groove 60 open to and formed through inside surface 20. Track is radially spaced outward from cavity 42. In one embodiment, track 60 is an arc such as a substantially semi-circular arc and is concentrically positioned relative to cavity 42. Track 60 is formed with a radius greater than the radii of either first or second portion 46, 48 of cavity 42. More specifically, track 60 is positioned between cavity 42 and center 44 of base 12. In one example, a registration dimple or indentation 62 is formed in track 60 near one end 64 of track 60. Dimple 62 is portion of track 60 extending further into base 12 than the remainder of track 60. In one example, the transition from the remainder of track 60 to dimple 62 is substantially abrupt, as opposed to being a tapered or gradual transition, to effectively form a cavity within the dimple below the remainder of track 60 when compact 10 is in the orientation of FIG. 2B and 2C.

In one embodiment, base 12 includes an injection molded member formed of a polymeric material such as polycarbonate or any other suitable injection molded material. In one example, the injection molded member is plated or covered with a metallic or other suitable plating or coating. For instance, base 12 may include a core injection molded member 70 with a plating 72 such as a brushed or polished aluminum plating enclosing injection molded member 70. In one example, the cavity 42 of base 12 is defined by core member 70, and plating 72 extends over core, molded member 70 and through cavity 42 to define internal wall 50. In other embodiments, base 12 does not include plating 72 and/or is formed of any other suitable material(s).

Figure 4:
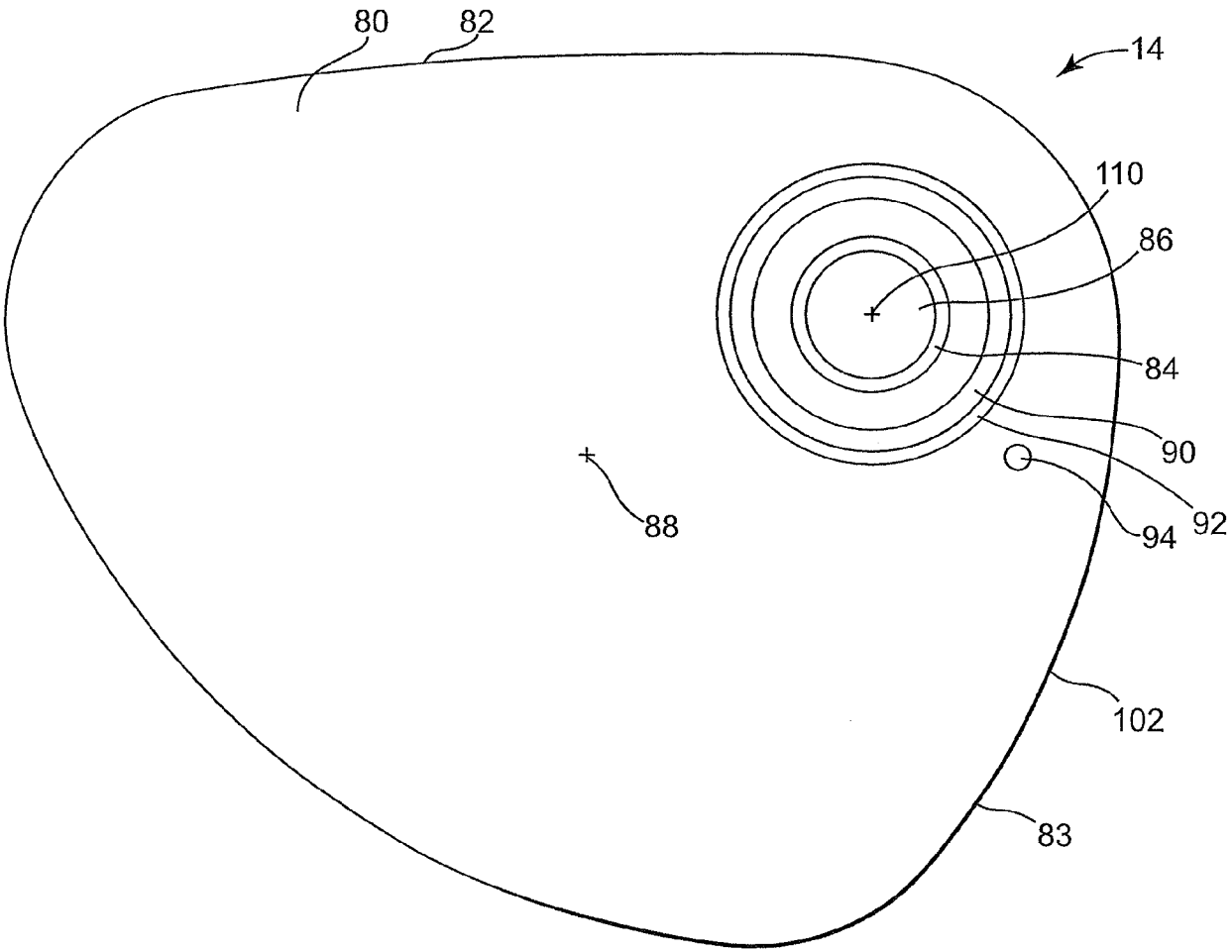
FIG. 4 is a bottom view illustration of one embodiment of a lid of the cosmetic compact of FIG. 1.

Referring e.g. to FIGS. 1 and 4, lid 14 defines an inside surface 80 and an outside surface 82 opposite inside surface 80. In one example, outside surface 82 is substantially convex and is spaced from inside surface 80 except near a perimeter edge 83 of inside surface 80 where the overall thickness of lid 14 gradually decreases such that outside surface 82 curves toward and intersects edge 83 of inside surface 80. As such, base 12 is presented with a sleek and smooth-line exterior appearance as shown, for example, in FIG. 2B. Lid 14 is formed with a similar shape and size as base 12. In one embodiment, outer dimensions of lid 14 are similar to, but reversed with respect to, outer dimensions of base 12 to form a substantially symmetrical compact 10 when assembled and closed as illustrated, for example, in FIG. 2B.

Referring e.g. to FIGS. 2C and 4, in one embodiment, lid 14 defines a cylindrical or frustoconical internal wall 84 defining an aperture 86 extending between the inside and outside surfaces 80 and 82. Aperture 86 is formed with a similar cross-sectional diameter as aperture 52 in base 12, is spaced from a center 88 of lid 14, and is positioned to align with aperture 52 of base 12 when compact 10 is assembled.

Lid 14 also defines a portion of coupling mechanism 40 (illustrated in e.g. FIGS. 1 and 2C). More specifically, in one example, a circular collar 90 is defined by lid 14 and extends from inside surface 80 away from the remainder of lid 14. Collar 90 is positioned concentrically about aperture 86 and is sized to fit within the first portion 46 of cavity 42 in base 12. In one embodiment, collar 90 is formed substantially continuously while in other embodiments, collar 90 may include a plurality of discrete segments collectively defining a circular collar 90.

In one embodiment, a generally circular tab 92 extends about an end of collar 90 opposite inside surface 80 of base 12. Tab 92 extends radially outward from collar 90 to define an outer diameter of tab 92 that is greater than the diameter of first portion 46 and less than the diameter of second portion 48 of cavity 42 of base 12. Tab 92 may be either a substantially continuous ring about collar 90 or may be collectively formed by a plurality of discrete segments. In one embodiment, collar 90 and/or tab 92 are elastically deformable to facilitate assembly of compact 10 as will be further described below.

In one example, a post or cam 94 extends from inside surface 80 of lid 14 and is radially spaced away from collar 90. Cam 94 is sized to fit within and move along track 60 of base 12 when compact 10 is assembled.

In one embodiment, lid 14 includes as an injection molded member formed of a polymeric material, such as polycarbonate, or any other suitable injection molded material. In one example, the injection molded member is plated or covered with a metallic or other suitable plating or coating. For instance, lid 14 may include a core injection molded member 100 with a plating 102 such as an aluminum plating 102 enclosing injection molded member 100. In one example, the core member 100 defines collar 90, and plating 102 defines internal wall 84 forming aperture 86. In other embodiment, lid 14 does not include plating 102 and/or is formed of any other suitable material(s).

Upon assembly, base 12 and lid 14 are rotatably coupled to one another. In particular, as illustrated with reference to FIG. 2C, base 12 is aligned with lid 14 such that aperture 52 aligns with aperture 86 to collectively define an aperture throughout an entire thickness of compact 10. Collar 90 is inserted into cavity 42. More specifically, as collar 90 is inserted into first portion 46 of cavity 42, collar deforms radially inward pass through first portion 46. As collar 90 continues to advance into cavity 42, collar 90, in particular tabs 92 extending therefrom, move into second portion 48 of cavity 42. The larger diameter of second portion 48 as compared to first portion 46 allows collar 90 to elastically return to it original, non-deformed state. As such, collar 90 is substantially received by first portion 46 of cavity 42 with tab 92 being received within second portion 48 of cavity 42. As such, tab 92 grasps base 12 at the transition between first portion 46 and second portion 48 of cavity 42, thereby, coupling base 12 and lid 14 to one another. The coupling of collar 90 within cavity 42 forms coupling mechanism 40 as a socket hinge defining a rotational axis 110 through the center of cavity 42 and collar 90. Rotational axis 110 extends substantially perpendicular to inside surface 20 of base 12 such that lid 14 is rotatable in a plane substantially perpendicular to the inside surface 20 of base 12 about rotational axis 110 to open and close compact 10 (i.e. to uncover and cover cosmetic item(s) maintained within compact 10).

Additionally referring to FIGS. 3 and 4, when base 12 is coupled to lid 14, cam 94 is positioned within track 60. More particularly, when compact 10 is in the closed position, cam 94 fits within registration dimple 62 of track 60. Due to the abrupt change of depth in track 60 to form dimple 62 described above, more than nominal forces are required to transition cam 94 of lid 14 to move out of dimple 62 and into the remainder of track 60. Since lid 14 is not generally rotatable relative to base 12 without moving cam 94 out of dimple 62 and into track 60, a stronger force is required to initiate rotation of lid 14 from the closed position. As such, dimple 62 functions to maintain or lock lid 14 in a closed position until a sufficient force is applied to move cam 94 out of dimple 62 and along track 60 to open lid 14.

Upon rotation of lid 14 to open compact 10, cam 94 travels from dimple 62 along track 60 toward a second end 120 of track 60 opposite dimple 62. In one embodiment, movement of lid 14 relative to base 12 is limited by interaction of cam 94 in track 60. More specifically, when cam 94 contacts a track end 120 opposite registration dimple 62, movement of lid 14 relative to base 12 as indicated by arrow 122 is halted. As such, compact 10 is assembled and ready for presentation to or use by an end user.

Once compact 10 is opened, the user can access cosmetic items 16. In one example, where cosmetic items 16 are each a fragrance cosmetic item, the user can apply the fragrance items 16 in any combination or ratio the user desires. In one embodiment, the user applies the fragrance item 16 with a finger to the user's body, while in other embodiments, an applicator (not illustrated) may be included within compact 10 to facilitate application of the fragrance item 16 to the user's body. In this manner, the user is able to create a customized fragrance. The customized fragrance may be based on the user's preferences, the time of day, the destination or event to which the user is or will be attending, or any other factors of the user's choosing. In one example, since the fragrance items 16 are selected and included within a single compact 10 to complement one another, nearly any combination of fragrance items 16 will still present a pleasing perfume, thereby alleviating much of the fear of what unknown fragrance combinations might smell like and encouraging user experimentation in mixing the provided fragrance items 16.

Following use of cosmetic items 16, lid 14 is rotated about axis 110 as indicated by arrow 18 in a direction substantially opposite the direction in which lid 14 was opened. In one embodiment, lid 14 is rotated in a counterclockwise direction to open compact 10 and is rotated in a clockwise direction to close compact 10. Upon closing, cam 94 moves through track 60 and eventually is received within registration dimple 62, which is configured to maintain cam 94, and therefore, lid 14, in a closed position until outside forces rotate lid 14 in an intentional attempt to open compact 10 Although the invention has been described with respect to particular embodiments, such embodiments are for illustrative purposes only and should not be considered to limit the invention. Various alternatives and changes will be apparent to those of ordinary skill in the art. Other modifications within the scope of the invention in its various embodiments will be apparent to those of ordinary skill.

What is claimed is:

1. A cosmetic compact including:

a base defining an inside surface and at least one receptacle for storing a cosmetic item extending from the inside surface into the base; and a lid coupled with the base in a manner allowing the lid to rotate relative to the base about a rotational axis, the rotational axis being substantially perpendicular to the inside surface of the base and being fixed in position relative to each of the base and the lid;

wherein the lid is configured to rotatably transition from a closed position where the lid covers the at least one receptacle and an open position where the at least one receptacle is accessible by a user, one of the base and the lid defines a curvilinear track, and the other of the base and the lid includes a cam configured to be received within and to move along the track upon rotation of the lid relative to the base, and the track is radially spaced from and concentric with the rotational axis.

2. The cosmetic compact of claim 1, further comprising:

a cosmetic item stored in the at least one receptacle.

3. The cosmetic compact of claim 2, wherein the cosmetic item is a solid fragrance.

4. The cosmetic compact of claim 1, wherein the at least one receptacle includes a first receptacle, a second receptacle, and a third receptacle, the cosmetic compact further comprising:

a first solid fragrance stored in the first receptacle;

a second solid fragrance stored in the second receptacle; and a third solid fragrance stored in the third receptacle;

wherein each of the first solid fragrance, the second solid fragrance, and the third solid fragrance is different from the others of the first solid fragrance, the second solid fragrance, and the third solid fragrance.

5. The cosmetic compact of claim 1, wherein the base includes a first frustoconical aperture and the lid includes a second frustoconical aperture aligned with the first frustoconical aperture to collectively extend throughout a thickness of the compact.

6. The cosmetic compact of claim 1, wherein the base defines a cylindrical cavity and the lid includes a circular collar that is received by the cavity to couple the base to the lid in a manner allowing the collar to rotate relative the cavity.

7. The cosmetic compact of claim 1, wherein the base defines the curvilinear track and the lid includes the cam configured to be received within and to move along the track upon rotation of the lid relative to the base.

8. The cosmetic compact of claim 1, wherein a registration dimple is included in the track, and wherein the cam is configured to fit within the track when the lid is in a closed position to selectively maintain the lid in the closed position.

9. The cosmetic compact of claim 8, wherein the track defines a first end opposite the registration dimple configured to limit rotation of the lid relative the base.

10. The cosmetic compact of claim 1, wherein a first one of the base and the lid defines a cylindrical cavity, a second one of the base and the lid defines a circular collar, and each of the cylindrical cavity and the circular collar are laterally centered relative to the rotational axis.

11. The cosmetic compact of claim 10, wherein the cylindrical cavity defines a first portion and a second portion, the first portion extends from a substantially planar surface of the first one of the base and the lid, the second portion extends from the first portion opposite the substantially planar surface and defines a larger circumference than the first portion, the circular collar defines a substantially circular tab extending radially outwardly from an end of the circular collar opposite a remainder of the second one of the base and the lid, and the substantially circular tab is positioned within the second portion of the cylindrical cavity immediately adjacent the first portion of the cylindrical cavity in a manner coupling the base to the lid.

12. The cosmetic compact of claim 1, wherein the base defines a first aperture extending entirely through the base, the lid defines a second aperture extending entirely through the lid, and the first aperture and the second aperture are each coaxially aligned with the rotational axis.

13. A cosmetic container comprising:

a first member defining an inside surface and a first aperture extending through the first member substantially perpendicular to the inside surface;

one or more cosmetic items stored in the first member and being accessible from the inside surface of the first member; and a second member defining a second aperture extending through the second member, the second member being rotatably coupled with the first member to coaxially align the first aperture with the second aperture, wherein the second member is configured to rotate relative to the first member to selectively cover and uncover the one or more cosmetic items;

wherein one of the first member and the second member defines a curvilinear track radially spaced from and concentrically positioned relative to the first aperture, and the other of the first member and the second member defines a cam configured to move within the track when the second member is rotated relative to the first member.

14. The cosmetic container of 13, wherein each of the first aperture and the second aperture are defined with a frustoconical shape.

15. The cosmetic container of claim 13, wherein the second member is configured to rotate relative to the first member about the second hole.

16. The cosmetic container of claim 13, wherein the first member includes a cylindrical cavity extending around the first aperture, the second member includes a circular collar concentrically positioned with respect to the second aperture, and wherein the cylindrical cavity receives the circular collar to couple the first member to the second member.

17. The cosmetic container of claim 13, wherein the first member defines the curvilinear track spaced from and concentrically positioned relative to the first aperture, and the second member defines the cam configured to move within the track when the second member is rotated relative to the first member.

18. The cosmetic container of claim 13, wherein the second member is configured to rotate relative to the first member about a rotational axis, the rotational axis is coaxially aligned with and extends through each of the first aperture and the second aperture, and the rotational axis is fixed relative to each of the first member and the second member.

19. The cosmetic container of claim 18, wherein the one of the first member and the second member includes a cylindrical cavity extending around the rotational axis, the other of the first member and the second member includes a circular collar concentrically positioned with respect to the rotational axis, and wherein the cylindrical cavity receives the circular collar to couple the first member to the second member.

20. A method of assembling a cosmetic product, the method comprising:

storing one or more cosmetic items in a base, wherein the one or more cosmetic items can be accessed via a first surface of the base; and rotatably coupling a lid to the base such that the lid rotates in a plane substantially parallel to the first surface of the base about a rotational axis to cover and uncover the one or more cosmetic items;

wherein:

one of the base and the lid defines a cylindrical cavity, the other of the base and the lid defines a circular collar, each of the cylindrical cavity and the circular collar are laterally centered relative to the rotational axis, the cylindrical cavity defines a first portion and a second portion, the first portion extends from an inside surface of the one of the base and the lid, the second portion extends from the first portion opposite the inside surface of the one of the base and the lid and defines a larger circumference than the first portion, the circular collar defines a substantially circular tab extending radially outwardly from an end of the circular collar opposite a remainder of the other of the base and the lid, and wherein rotatably coupling the lid to the base includes positioning the substantially circular tab within the second portion of the cylindrical cavity immediately adjacent the first portion of the cylindrical cavity.

21. The method of claim 20, wherein storing the one or more cosmetic items includes storing three fragrances including a bottom note fragrance, a middle note fragrance, and a top note fragrance.

22. The method of claim 20, wherein rotatably coupling the lid to the base includes positioning a cam defined by the one of the base and the lid within a track defined b the other of the base and the lid, the track including a registration feature configured to selectively receive the cam to maintain the lid in a position covering the one or more cosmetic items, and the track is curvilinear and concentric with and radially spaced from the rotational axis.

* * * * *